US005140667A

United States Patent [19]

Youngeberg

[11] Patent Number: 5,140,667

[45] Date of Patent: Aug. 18, 1992

[54] ELECTRIC STEAM HUMIDIFIER FOR MOUNTING ON THE HORIZONTAL BOTTOM WALL OR VERTICAL SIDE WALL OF AN AIR DUCT OF A FORCED AIR FURNACE

[75] Inventor: Judy L. Youngeberg, Manheim, Pa.

[73] Assignee: Herrmidifier Company, Inc., Lancast, Pa.

[21] Appl. No.: 750,921

[22] Filed: Aug. 28, 1991

[51] Int. Cl.[5] ..... F24F 6/10

[52] U.S. Cl. ..... 392/402; 392/392; 392/394; 261/142; 261/DIG. 15

[58] Field of Search ..... 392/392, 399, 396, 402, 392/403; 126/113; 261/141, DIG. 15

[56] References Cited

U.S. PATENT DOCUMENTS 1,147,775 7/1915 Zarella .
2,347,490 4/1944 Legeman .
2,993,107 7/1961 Fichtner .
3,337,715 8/1967 Finn .
3,823,922 7/1974 McElreath ..... 261/DIG. 15

*Primary Examiner*—Teresa J. Walberg
*Attorney, Agent, or Firm*—Brady, O'Boyle & Gates

[57] ABSTRACT

An electric steam humidifier having a water reservoir configured substantially as a right triangle, wherein the hypotenuse side of the reservoir can be selectively mounted on the exterior surface of the bottom wall and exterior surface of the vertical wall of an air duct of a forced air furnace.

10 Claims, 7 Drawing Sheets

ELECTRIC STEAM HUMIDIFIER FOR MOUNTING ON THE HORIZONTAL BOTTOM WALL OR VERTICAL SIDE WALL OF AN AIR DUCT OF A FORCED AIR FURNACE

BACKGROUND OF THE INVENTION

Various humidifiers have been provided for mounting either on the underside wall or vertical wall of a warm air supply duct or cold air return of a forced air furnace. Examples of these mounting arrangements are disclosed in U.S. Pat. No. 3,431,903, dated Mar. 11, 1969; and U.S. Pat. No. 3,472,496, dated Oct. 14, 1969, and include a frame mounted on the duct wall by a plurality of sheet metal screws or by a plurality of threaded studs and associated wing nuts. While these mounting arrangements have been satisfactory for their intended purpose, they have been characterized by the number of fasteners and time required for mounting the humidifier on the wall of the duct. Furthermore, the humidifiers have usually been configured as rectangular parallelepipeds which hold a larger volume of water than necessary when the humidifier is an electric steam type.

SUMMARY OF THE INVENTION

After considerable research and experimentation, the humidifier of the present invention and the mounting assembly therefor have been devised to overcome the disadvantages experienced with prior humidifiers, and comprises, essentially, a water reservoir constructed to have a substantially right triangular configuration containing an electrical heating element for heating the water in the reservoir to form steam which is directed into the duct. By employing a triangular configuration rather than a rectangular parallelepiped configuration, the volume of water in the reservoir is reduced, thereby allowing the water to form steam faster, whereby the humidifier is given a faster response time to the call for humidity. Also, the additional angles, bends and radii increase the structural strength of the reservoir to make it stronger and sturdier than the rectangular parallelepiped configuration.

To mount the humidifier on the bottom wall of an air duct, preferably but not limited to a warm air duct, a triangular opening, corresponding to the triangular shape of the upper edge portion of the reservoir, is cut through the bottom wall of the duct and a pair of reversely bent brackets are respectively mounted on the hypotenuse side of the triangular opening and the opposite side thereto, to thereby form a track for slidably receiving an outwardly extending flange or lip provided on the corresponding upper edge portion of the reservoir, whereby the triangular opening of the reservoir communicates directly with the interior of the duct.

To mount the humidifier on the vertical side wall of an air duct, preferably but not limited to a warm air duct, a rectangular opening is cut through the side wall, and a bracket is secured to the side wall below the lower edge of the opening. The bracket is provided with a pair of spaced hook portions adapted to receive a pair of correspondingly spaced slots provided in the lip of the reservoir on the hypotenuse side thereof. The bracket is also provided with a pair of outwardly extending fingers adapted to engage the side wall of the reservoir of the hypotenuse side thereof for maintaining the reservoir substantially level and to relieve stress from the spaced hook portions and cooperating slots. To direct the steam into the duct, a tapered, triangular hood having a rectangular outlet portion is fastened to the top edge or lip of the reservoir, whereby the rectangular outlet portion extends through the rectangular opening in the duct.

By the use of the respective brackets for mounting the humidifier on the bottom wall of the air duct, and the side wall of the duct, the installation of the unit can be accomplished more quickly than heretofore.

DESCRIPTION OF THE PREFERRED EMBODIMENTS

Figure 1:
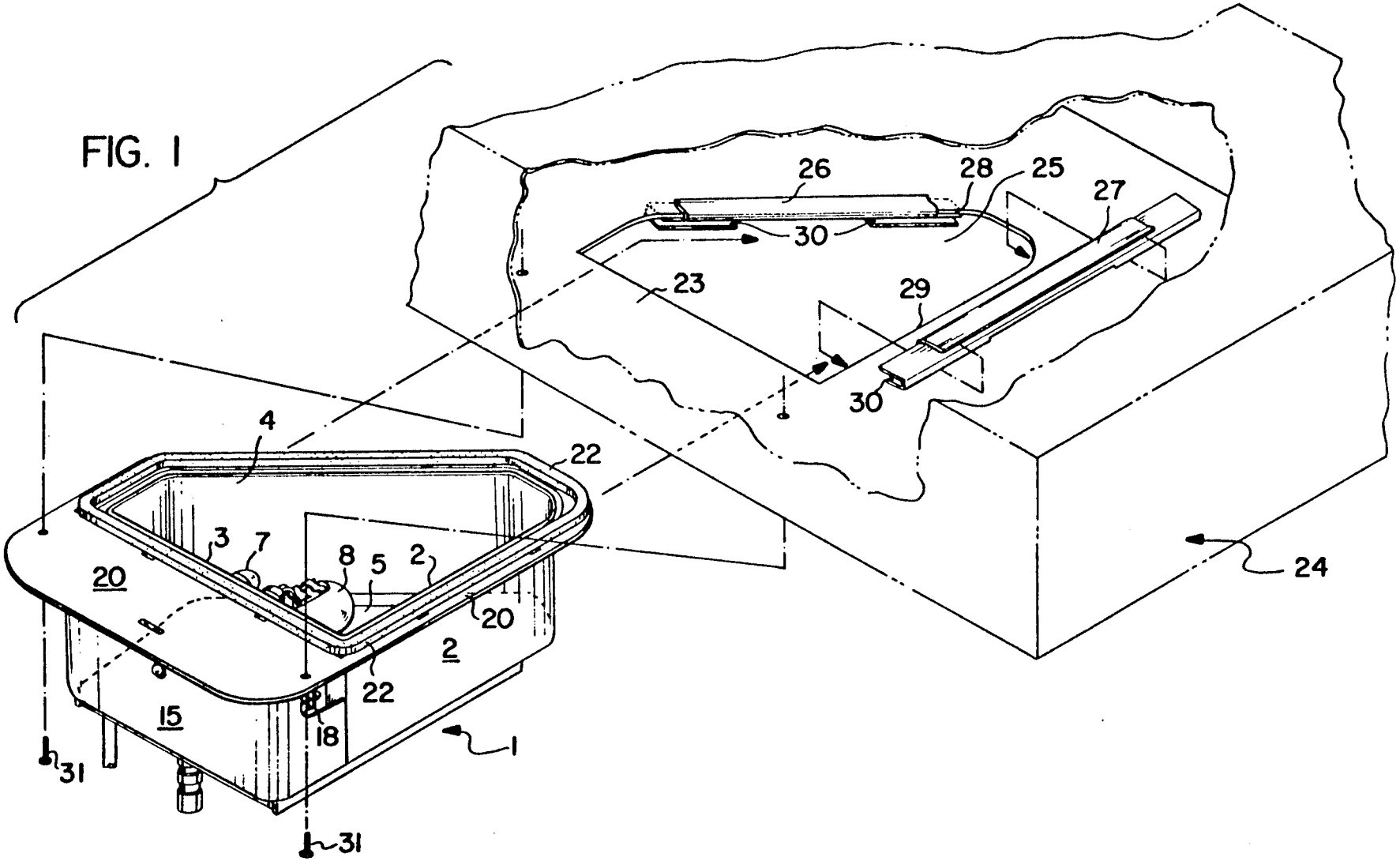
FIG. 1 is a perspective view of the humidifier of the present invention illustrating the steps of mounting the humidifier on the bottom wall of an air duct.
Figure 2:
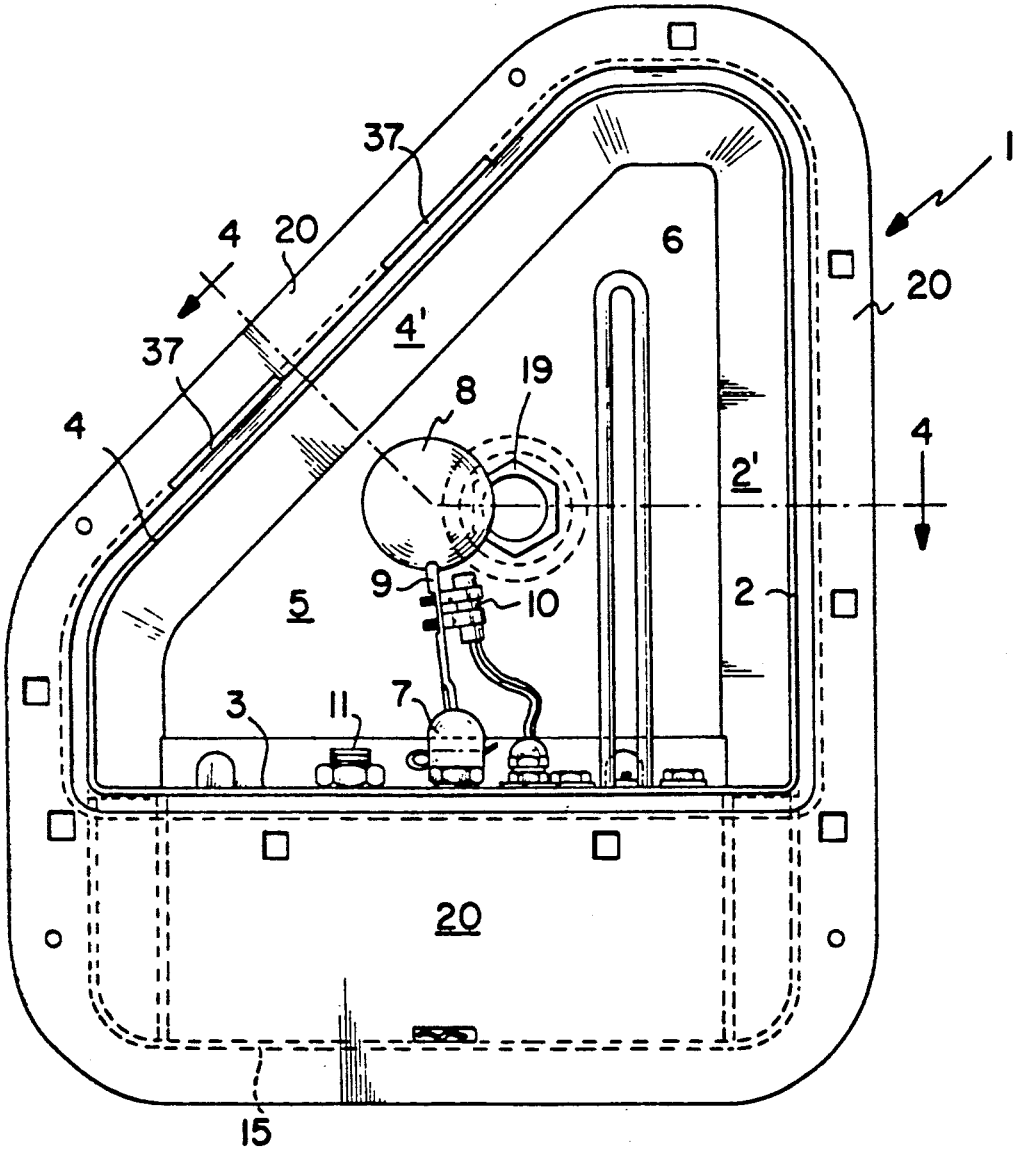
FIG. 2 is a top plan view of the humidifier.

Referring to the drawings and more particularly to FIGS. 1 to 4, the humidifier of the present invention comprises a water reservoir 1 having a substantially right triangular configuration with a top opening, including side walls 2 and 3 disposed at right angles to each other, a hypotenuse wall 4 extending between the ends of walls 2 and 3, and a bottom wall 5. To strengthen the construction, the bottoms of at least walls 2 and 4 are preferably joined to bottom wall 5 by curved or diagonal portions shown at 2' and 4'. An electrical heating element, such as a calrod, 6 is mounted in the reservoir together with a water inlet valve 7 controlled by a float 8, having a pivotal arm 9 carrying a mercury tilt switch 10, which is electrically connected in the circuit to the heating element 6. The mercury switch 10 is mounted on the float arm 9 in such a manner so that when the water level in the reservoir is below the heating element, the switch 10 remains open, thereby preventing electrical power from being supplied to the heating element 6, thus, preventing the element from being damaged due to overheating. When the water inlet valve 7 is moved to the open position by the float 8, to allow water to enter the reservoir, when the water covers the heating element 6, and reaches a predetermined level in the reservoir, the mercury switch 10 becomes tilted to a position to close the electrical circuit to the heating element 6, whereby the heating element is energized to heat the water to form steam. As the water is boiled off, and the water level in the reservoir dips, the float actuated valve 7, once again opens to allow replenishment water to flow into the reservoir.

Figure 3:
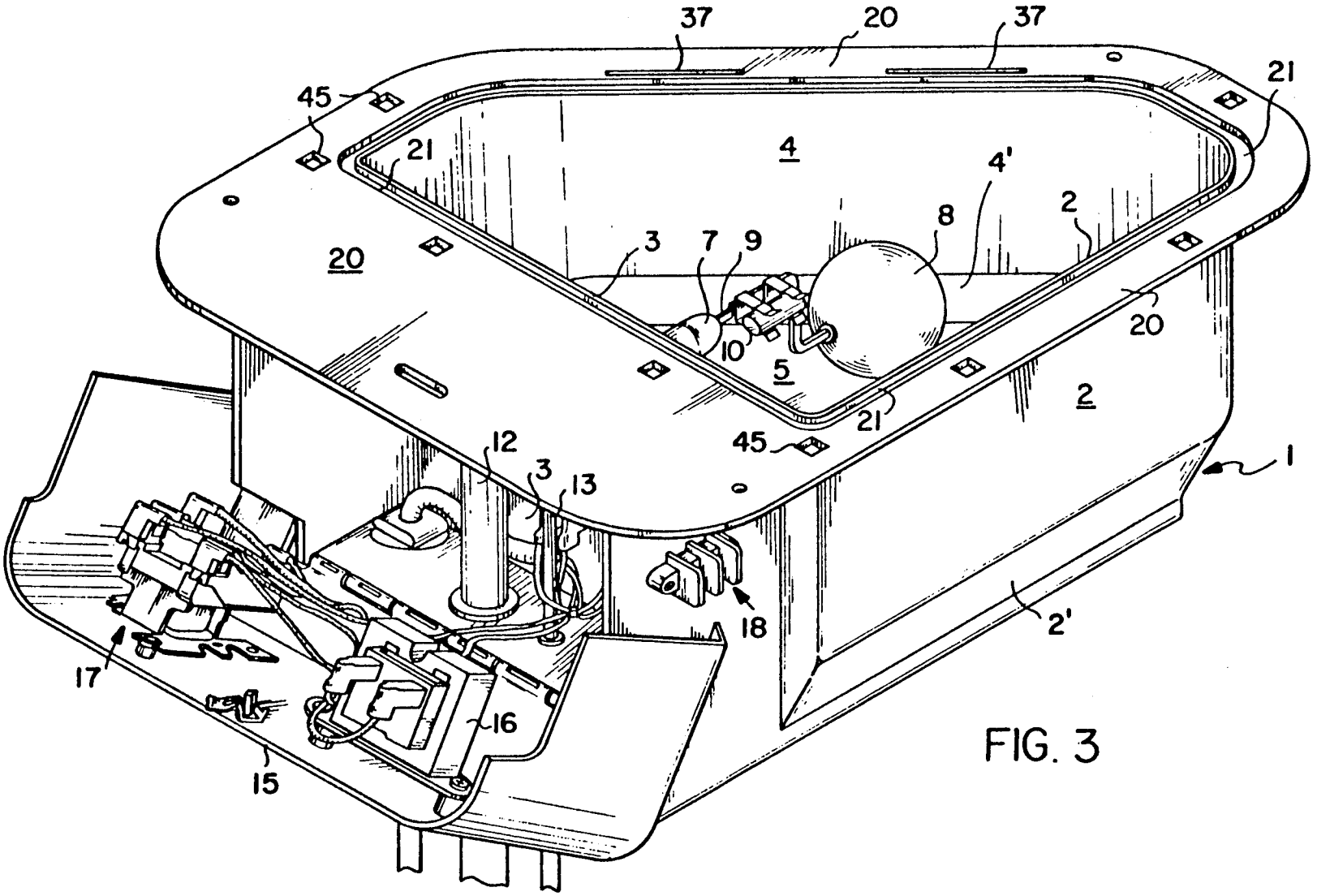
FIG. 3 is an enlarged perspective view of the humidifier showing the access door to the electrical components in the open position.
Figure 4:
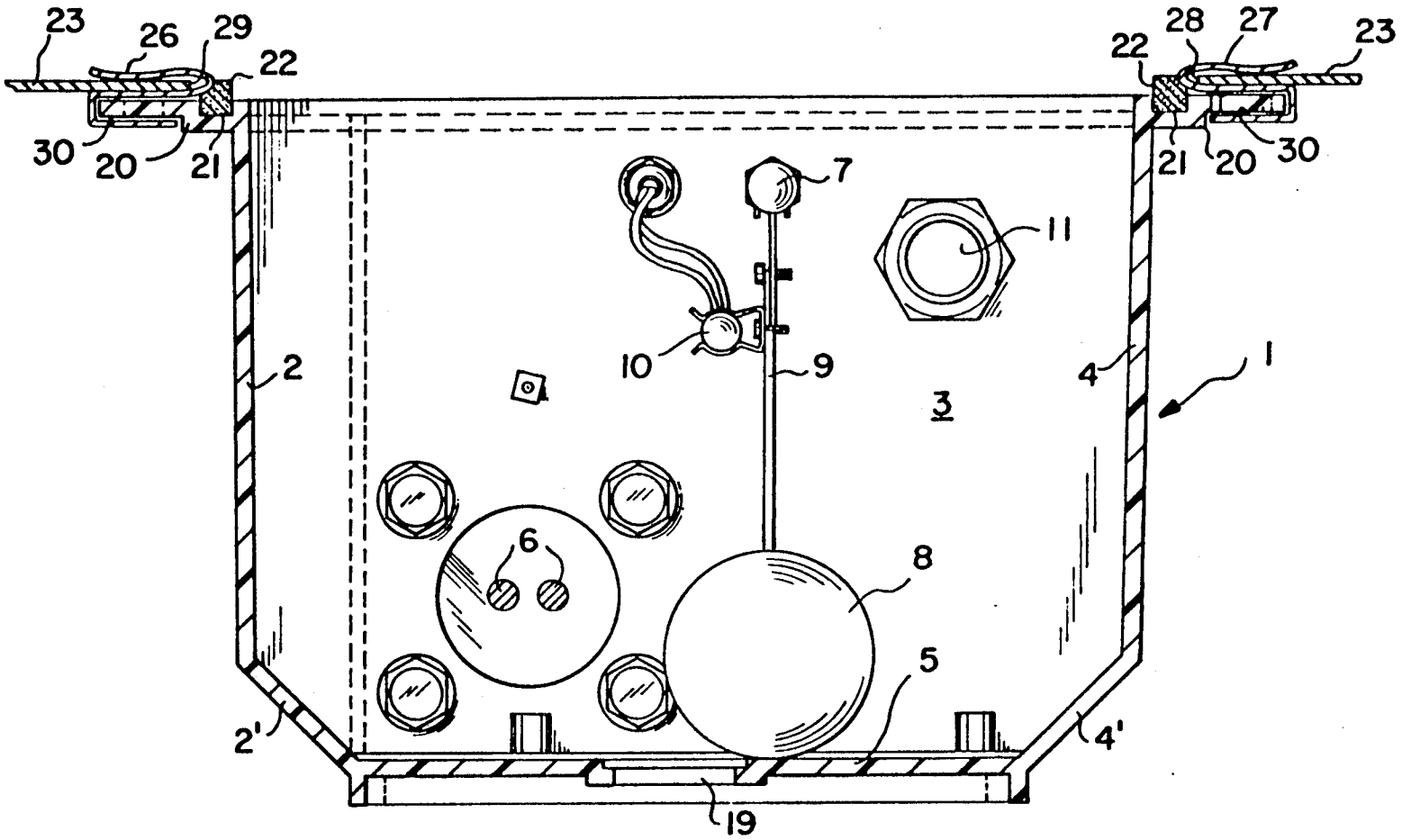
FIG. 4 is a fragmentary, sectional end view taken substantially along line 4—4 of FIG. 2, and showing the humidifier of FIG. 1 in the mounted position on the bottom wall of an air duct.

As will be seen in FIG. 4, the wall 3 is provided with an overflow port 11 which communicates with a drain line 12, shown in FIG. 3, a water supply line 13 also being provided for connection to the water inlet valve 7. The drain line 12 and its connection with overflow port 11, and water supply line 13 and its connection to water inlet valve 7, are housed within a compartment 14 adjacent the side wall 3, the compartment including a hinged access door 15 upon which are mounted a transformer 16 and relays 17 connected in the electrical control circuit for the heating element 6. A humidistat and fan interlock terminal 18 is mounted on the side wall of the compartment for connecting the circuit of the humidifier to a remote humidistat and to the furnace and air handler circuit. A closable drain opening 19 is provided in the bottom wall 5 of the reservoir so that the water in the reservoir can be drained therefrom for cleaning and prior to performing maintenance on the humidifier. The hinged access door 15 is shown in the open position in FIG. 3, which clearly shows the ease of access to the normally concealed components and connections for purposes of initial connection and maintenance.

The upper edge of the reservoir 1 is provided with an outwardly extending flange or lip 20, the portion of the lip 20 extending from sides 2 and 4 being narrower than the portion extending from the wall 3. A peripheral groove 21 is provided in the lip 20 for receiving a suitable gasket 22.

From the above description it will be appreciated by those skilled in the art that the construction and arrangement of the triangular configuration of the reservoir 1 results in a reduced volume of water in the reservoir by about one half, thereby allowing the water to form steam faster than if the reservoir was rectangular. The reservoir, which is preferably molded of plastic material, is stronger due to the additional angles, bends and radii produced by the hypotenuse wall 4. The length of reservoir wall 2 is chosen to be just somewhat longer than the length of heating element 6 and to allow sufficient space between the heating element 6 and wall 2, 2' and hypotenuse wall 4, 4' and to allow sufficient clearance for the unhampered operation of float 8 on pivotal arm 9.

Referring to FIGS. 1 and 4, to mount the humidifier on the bottom wall 23 of an air duct 24, a triangular opening 25, corresponding to the triangular upper edge opening of the reservoir 1, is cut into the bottom wall 23, and a pair of reversely bent brackets 26, 27, S-shaped in cross-section, are respectively mounted on the edge 28 of the bottom wall 23 adjacent the hypotenuse side of the triangular opening, and the edge 29 of the bottom wall opening on the opposite side thereto. The reversely bent brackets 26 and 27 are at an acute angle to each other and provide a guide or track 30 extending below the wall 23 of the duct for slidably receiving the lip 20 provided on the corresponding upper edge portions of the reservoir, whereby the triangular top opening of the reservoir communicates directly with the interior of the duct 24 through opening 25. The perimeter of the opening between the bottom wall 23 and lip 20 is sealed by gasket 22. Since the reversely bent brackets 26 and 27 are at an acute angle to each other, they provide an automatic stop and alignment of the top opening of the reservoir and duct opening 25, as the lips 20 of angularly disposed reservoir sides 4 and 2 are slid along tracks 30. To secure the reservoir 1 in the mounted position, sheet metal screws 31 are threaded through the flange portion 20 and bottom wall 23 of the duct.

Figure 5:
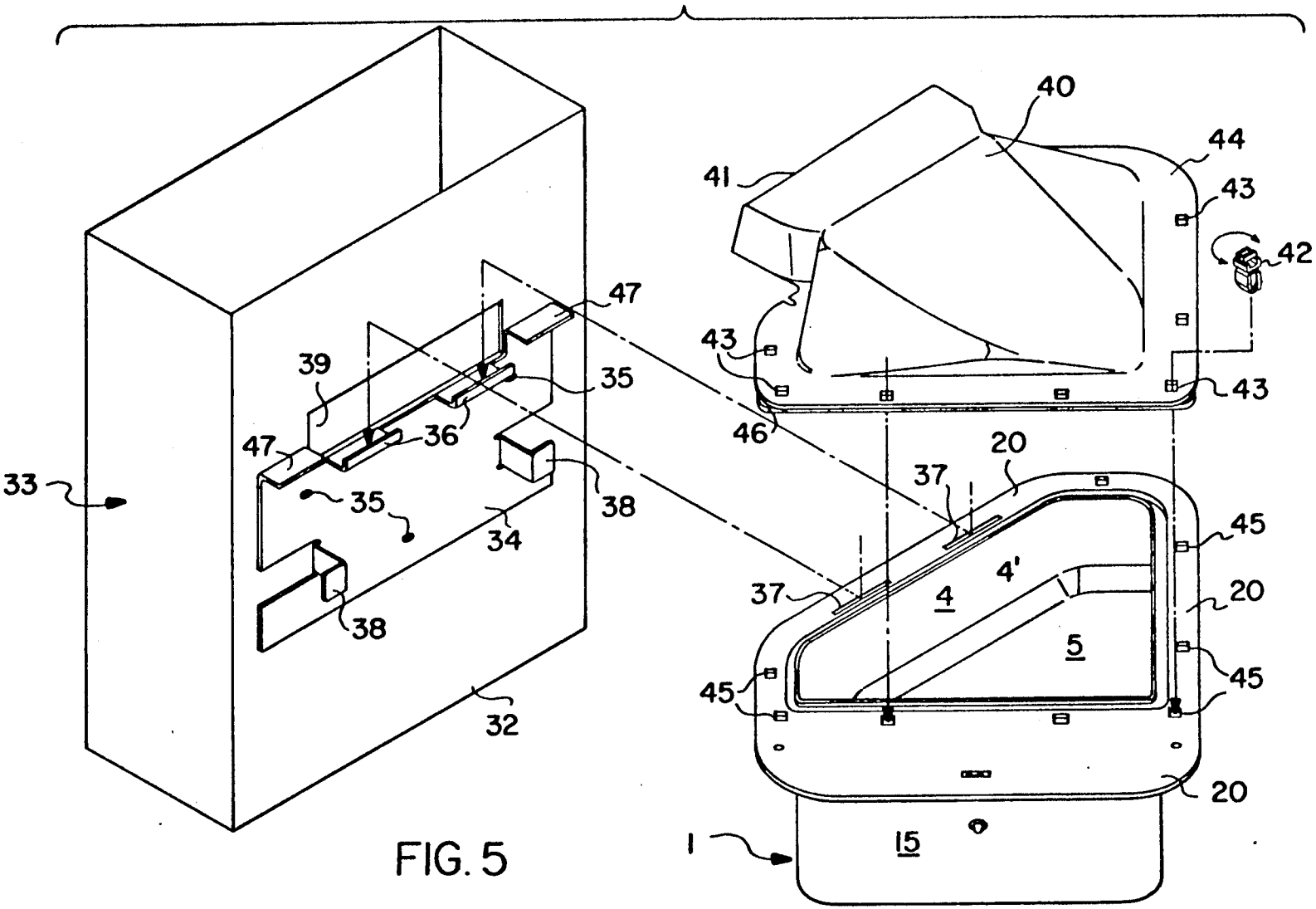
FIG. 5 is a perspective view of the humidifier of the present invention illustrating the steps of mounting the humidifier on the vertical side wall of an air duct.
Figure 7:
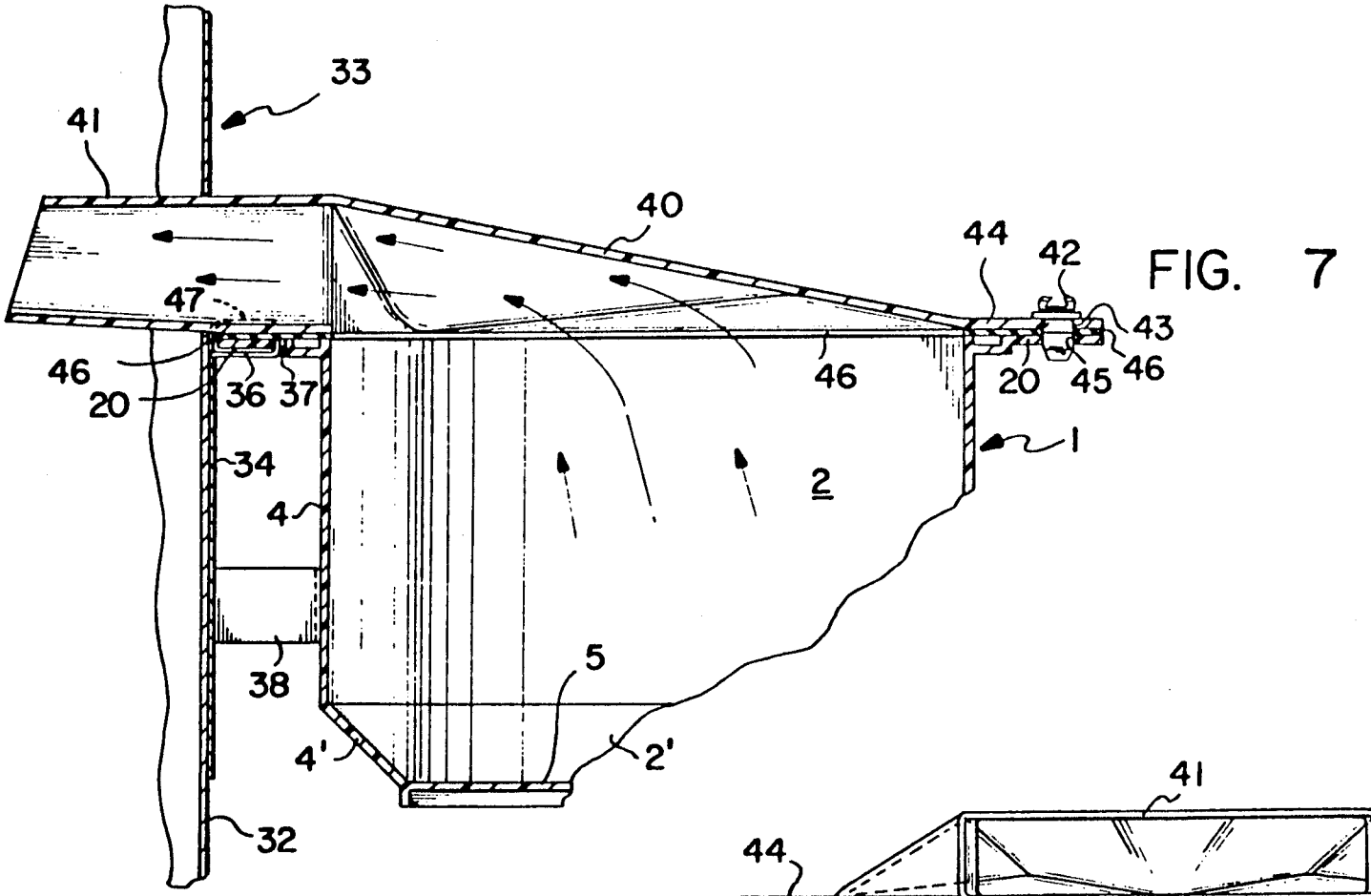
FIG. 7 is a view taken along line 7—7 of FIG. 6.
Figure 8:
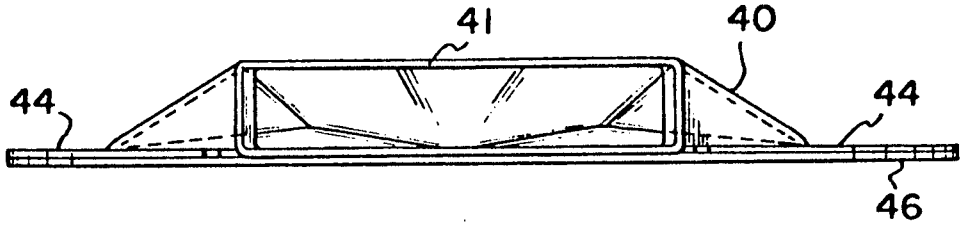
FIG. 8 is an end elevational view of the outlet portion of the humidifier hood.

Referring to FIG. 5, to mount the humidifier on the vertical side wall 32 of an air duct 33, a bracket 34 is fastened by screws as at 35 to the side wall. A pair of hook members 36 are bent outwardly from the plane of the bracket in proximity of the upper edge portion thereof and are insertable into slots 37 provided in the lip 20 on the hypotenuse side 4 of the reservoir 1. A pair of arms 38 are bent outwardly from the plane of the bracket adjacent the side edge portions thereof, and spaced below the pair of hook members 36, and engage the exterior of wall 4 of the reservoir, as shown in FIG. 7, whereby the reservoir 1 is maintained level, and undue stress between the reservoir lip 20 and cooperating hook members 36 is prevented.

Figure 6:
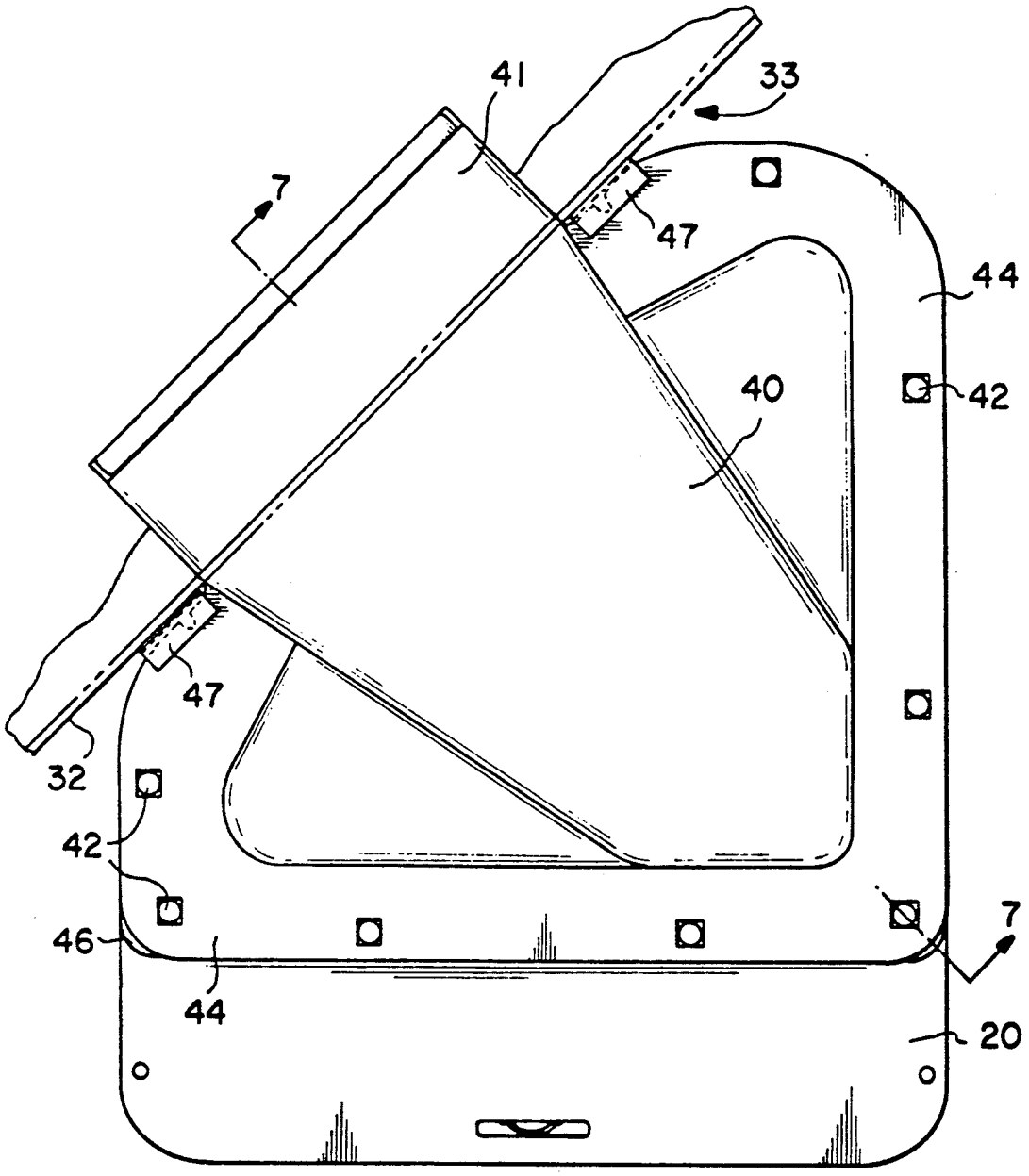
FIG. 6 is a top plan view of the humidifier and associated hood.

In order to direct steam from the reservoir 1 to the interior of the duct 33, a rectangular opening 39 is provided in the vertical wall of the duct above the hook members 36 of bracket 34, and a tapered hood 40, having a rectangular outlet portion or snout 41 extending through the duct opening 39, is secured to the lip 20 of the reservoir by suitable fasteners 42 extending through apertures 43 provided in a flange portion 44 of the hood 40 and aligned with similar apertures 45 provided in the lip 20 of the reservoir. Only one fastener 42 is shown in FIG. 5 but it is understood that there is a fastener in each pair of mating apertures 43, 45, as shown in FIG. 6. As will be seen in FIG. 7, a gasket 46 is interposed between the lip 20 of the reservoir and the flange portion 44 of the hood 40 so that steam exits from the unit only through outlet portion 41.

To mount the humidifier to the side wall 32 of the duct 33, a rectangular opening 39 is first cut into the duct side wall and the bracket 34 is fastened to the side wall so that the hook members 36 are adjacent the lower edge of the rectangular opening 39. The reservoir 1 is then hooked to the bracket 34 by inserting the hook members 36 through the slots 37 in the reservoir lip 20. The hood 40, with the gasket 46 in place, is then positioned on the top edge of lip 20 of the reservoir with the rectangular outlet portion 41 extending through the duct opening 39, the hood being secured in place by the fasteners 42. Bracket 34 on the upper outer edges includes a pair of retainer portions 47 bent outwardly from the bracket at positions above and outwardly of the hook members 36, which engage the top of flange portion 44 on opposite sides of outlet portion 41 to assist in retaining the humidifier on hook members 36.

The two different mounting assemblies described herein facilitate the mounting of the reservoir with relative ease on either the bottom wall or vertical side wall of an air duct without requiring the time and number of fasteners as needed heretofore.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. An electric steam humidifier for selectively mounting on the exterior surface of the bottom wall and exterior surface of a vertical side wall of an air duct of a forced air furnace comprising, a water reservoir, an electrical heating element mounted in the reservoir for heating the water therein to form steam to be directed to the interior of the air duct, said reservoir having a substantially right triangular configuration including a bottom wall, a hypotenuse side wall and oppositely extending side walls, and an open right triangular top communicating with the interior of the air duct, and means for connecting the hypotenuse side wall of the reservoir to the selected wall of the air duct.

2. An electric steam humidifier according to claim 1, wherein a triangular opening is provided in the bottom wall of the air duct corresponding to the triangular open top of the reservoir, an outwardly extending lip provided around the top edge portion of the reservoir, a reversely bent bracket mounted on the edge of the bottom wall of the duct adjacent the hypotenuse side of the triangular opening, a guide provided on said bracket, the lip portion on the hypotenuse side of the reservoir being slidably mounted in said guide.

3. An electric steam humidifier according to claim 2, wherein a second reversely bent bracket including a guide is mounted on the edge of the bottom wall of the bottom wall opening on the side thereof opposite from the hypotenuse side of the triangular opening, the lip portion on the corresponding side of the reservoir being slidably mounted in the guide of the second bracket.

4. An electric steam humidifier according claim 1, wherein an opening is provided in the side wall of the air duct, a bracket secured to the side wall of the duct adjacent said opening, means for detachably connecting the hypotenuse side wall of the reservoir to said bracket, and hood means connected to the open top of said reservoir and communicating with said duct opening for directing steam from said reservoir into said duct.

5. An electric steam humidifier according to claim 4, wherein the means for detachably connecting the hypotenuse side wall of the reservoir to the bracket comprises, a pair of hook members extending outwardly from the bracket in a direction away from the side wall of the duct, an outwardly extending lip provided around the top edge portions of the reservoir, and a pair of slots provided in the lip of said reservoir on the hypotenuse side wall thereof, said hooks extending through said slots, whereby the reservoir is hung on the side wall of the duct.

6. An electric steam humidifier according to claim 5, including spacer means extending outwardly from the bracket in a direction away from the side wall of the duct, and said spacer means engaging the hypotenuse side wall of the reservoir to maintain the reservoir level.

7. An electric steam humidifier according to claim 5, wherein a pair of arms are integral with the bracket and extend outwardly therefrom in a direction away from the side wall, the arms having free ends engaging the hypotenuse side wall of the reservoir, whereby the reservoir is maintained level, and undue stress between the reservoir lip and cooperating hook members is prevented.

8. An electric steam humidifier according to claim 7, in which said pair of arms are spaced below said pair of hook members, and said free ends of said pair of arms engaging the hypotenuse side wall at a position spaced below said lip.

9. An electric steam humidifier according to claim 4, wherein the opening in the side wall of the duct is rectangular, and the hood means comprises a tapered portion terminating in a peripheral flange portion, and a rectangular outlet portion integral with said tapered portion, said outlet portion extending transversely through the opening in the duct side wall, an outwardly extending lip provided around the top edge portion of the reservoir, and means for securing the flange portion of said hood means to the lip of said reservoir.

10. An electric steam humidifier according to claim 1, in which said hypotenuse side wall and one of the oppositely extending side walls to which it is connected, have lower portions, substantially diagonal wall portions integrally connecting said lower portions of said hypotenuse side wall and said one of the oppositely extending side walls to said bottom wall of said reservoir.

* * * * *